US007296497B2

(12) United States Patent
Kugelberg et al.

(10) Patent No.: US 7,296,497 B2
(45) Date of Patent: Nov. 20, 2007

(54) METHOD AND DEVICE FOR MANUFACTURING A DRILL BLANK OR A MILL BLANK

(75) Inventors: Jörgen Kugelberg, Huddinge (SE); Roine Ericsson, Huddinge (SE); Jonathan Fair, Coventry (GB); Anders Micski, Huddinge (SE)

(73) Assignee: Sandvik Intellectual Property AB, Sandviken (SE)

( * ) Notice: Subject to any disclaimer, the term of this patent is extended or adjusted under 35 U.S.C. 154(b) by 115 days.

(21) Appl. No.: 11/121,125

(22) Filed: May 4, 2005

(65) Prior Publication Data

US 2006/0027046 A1 Feb. 9, 2006

(30) Foreign Application Priority Data

May 4, 2004 (SE) ..... 0401150

(51) Int. Cl.
*B21K 5/04* (2006.01)

(52) U.S. Cl. ..... 76/108.6; 76/108.1; 29/527.5; 29/530

(58) Field of Classification Search ..... 76/5.1, 76/108.1, 108.6; 72/254, 257, 260; 29/527.5, 29/530

See application file for complete search history.

(56) References Cited

U.S. PATENT DOCUMENTS 2,954,121 A * 9/1960 Benson ..... 72/257
3,422,648 A * 1/1969 Lemelson ..... 72/17.2
4,779,440 A 10/1988 Cleve et al. ..... 72/260
5,438,858 A * 8/1995 Friedrichs ..... 72/260
6,450,739 B1 * 9/2002 Puide et al. ..... 408/144

FOREIGN PATENT DOCUMENTS

WO 00/74870 12/2000

* cited by examiner

*Primary Examiner*—M. Rachuba
(74) *Attorney, Agent, or Firm*—Drinker Biddle & Reath LLP

(57) ABSTRACT

The present invention relates to a method for manufacturing a drill blank or a mill blank by extrusion, said method comprising the forming of a first blank portion (B1) having external, axially extending external flutes and the forming of a further blank portion (B3) in the shape of a shaft. The invention also relates to a device for manufacturing a drill blank or a mill blank. The method according to the invention is characterised by: extruding a first blank portion (B1) having a free end and external flutes; allowing the extrusion to continue to supply further extruding mass into a cavity (6), said supply of extruding mass completely filling out the external flutes of the first blank portion (B1) to produce a second blank portion (B2) integral with the first blank portion (B1); allowing the extrusion to continue to produce a desired length of the first blank portion (B1); and cutting off the first blank portion (B1) at the end facing away from the second blank portion (B2).

16 Claims, 9 Drawing Sheets

METHOD AND DEVICE FOR MANUFACTURING A DRILL BLANK OR A MILL BLANK

BACKGROUND OF THE INVENTION

The present invention relates to a method for manufacturing a drill blank or a mill blank by extrusion comprising the forming of a first blank portion having external, helical chip flutes and the forming of a further blank portion in the shape of a shaft. The invention also relates to a device for manufacturing a drill blank or a mill blank. The drill blank or the mill blank is further treated in subsequent manufacturing steps to obtain a drill for chip removing machining.

U.S. Pat. No. 4,779,440 discloses a method for producing extruded drill blanks. The extruded drill blanks are equipped with external, helical grooves that serve as the beginnings for the subsequent chip spaces of the drill. Preferably, the chip spaces are produced by grinding. The drill blanks are obtained by extruding a heated hard metal material through a nozzle. The drill blanks can be joined to a handle in a manner known per se.

WO 00/74870 discloses a method for manufacturing a rotary tool such as a helix drill or an end mill for example, the method comprising the forming of a blank by an extrusion process. During the extrusion, a mixture is passed through a die which provides a cylindrical shape to the outer peripheral surface of the mixture. A plurality of jaws are disposed downstream of the die for conducting the mixture. Each jaw includes a helical ridge for engaging the outer surface of the extruded mass to cause a helical groove to be formed therein which constitutes a chip flute in the tool. During the extrusion, the jaws are moved away from the mixture to terminate formation of the chip grooves, whereby a shank portion of the tool is formed.

OBJECTS AND SUMMARY OF THE INVENTION

A primary object of the present invention is to teach a method and a device for manufacturing a drill blank or a mill blank where a portion having at least one chip flute is produced initially and a shaft portion is produced subsequently.

A further object of the present invention is to use friction to control the formation of the shaft portion of the drill blank or the mill blank.

A still further object of the present invention is to vary, independently of each other, the length of the drill portion and the shaft portion.

In one aspect of the invention, there is provided a method for manufacturing a drill blank or a mill blank by extrusion, said method comprising the forming of a first blank portion having external, axially extending external flutes and the forming of a further blank portion in the shape of a shaft, comprising: extruding a first blank portion having a free end and external flutes such that the free end and an adjacent portion of the first blank portion are extended into a cavity; sealing said cavity in the area of the free end of the first blank portion; further extruding mass to the cavity, said supply of extruding mass completely filling out the external flutes of the first blank portion to produce a second blank portion integral with the first blank portion; terminating said sealing to allow the second blank portion to be pushed out of the cavity; extruding a desired length of the first blank portion; and cutting off the first blank portion at the end facing away from the second blank portion.

In another aspect of the invention, there is provided a device for manufacturing a drill blank or a mill blank by extrusion, said device comprising a housing, a nozzle connected to said housing and means to bring an extruding mass in the housing to pass through the nozzle, said nozzle having an internal space that is in the shape of a drill geometry with external, axially extending flutes, a sleeve defining a cavity, said sleeve being attached to the nozzle, and a sealing and shearing means being provided at the end of the sleeve facing away from the nozzle, said sealing and shearing means being able to at least partly seal the end of the sleeve facing away from the nozzle.

BRIEF DESCRIPTION OF THE DRAWINGS

Below a preferred embodiment of the invention will be described, reference being made to the accompanying drawings, where.

DETAILED DESCRIPTION OF A PREFERRED EMBODIMENT OF THE INVENTION

Figure 1:
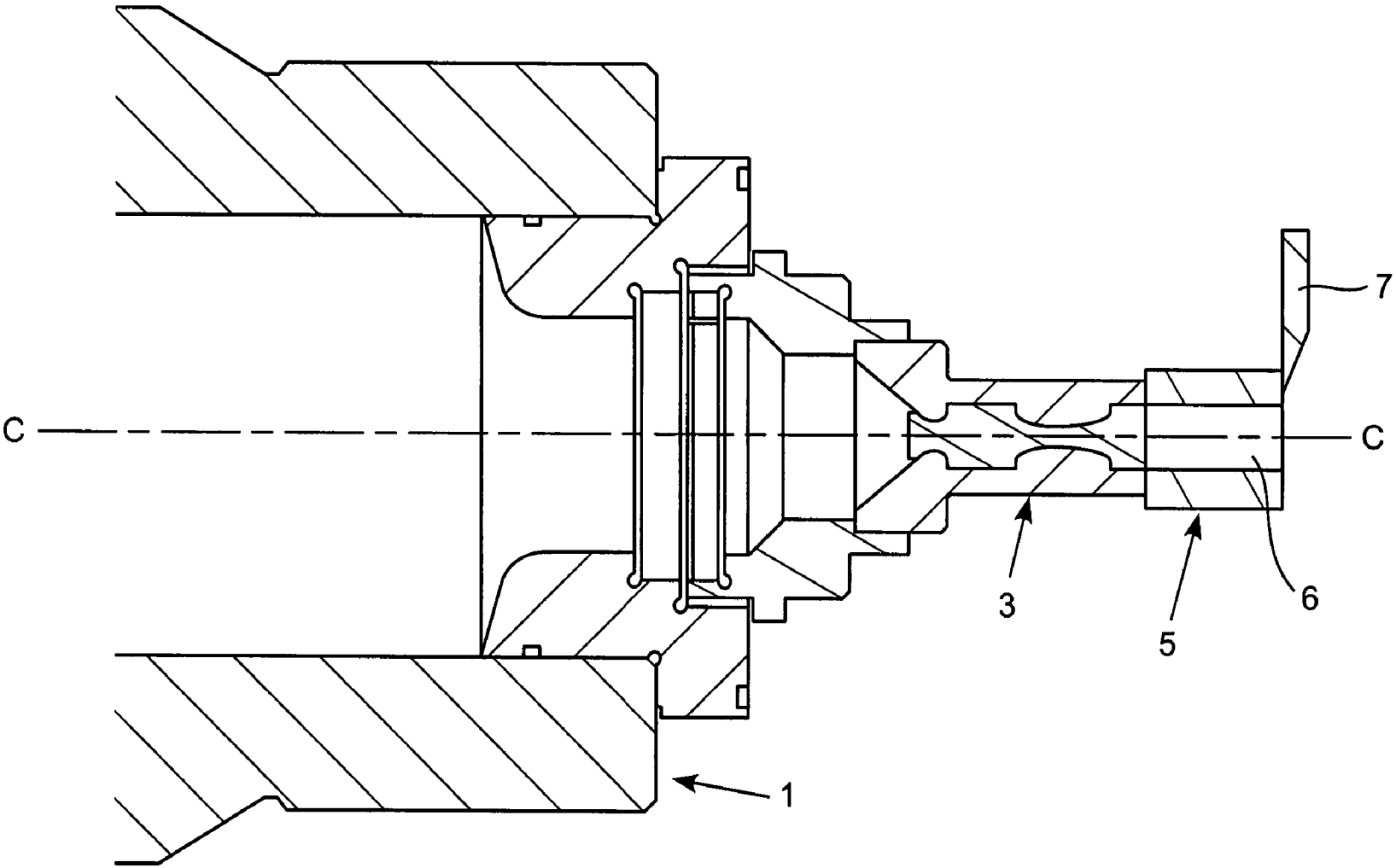
FIG. 1 shows a schematic side view of a device according to the present invention.
Figure 2:
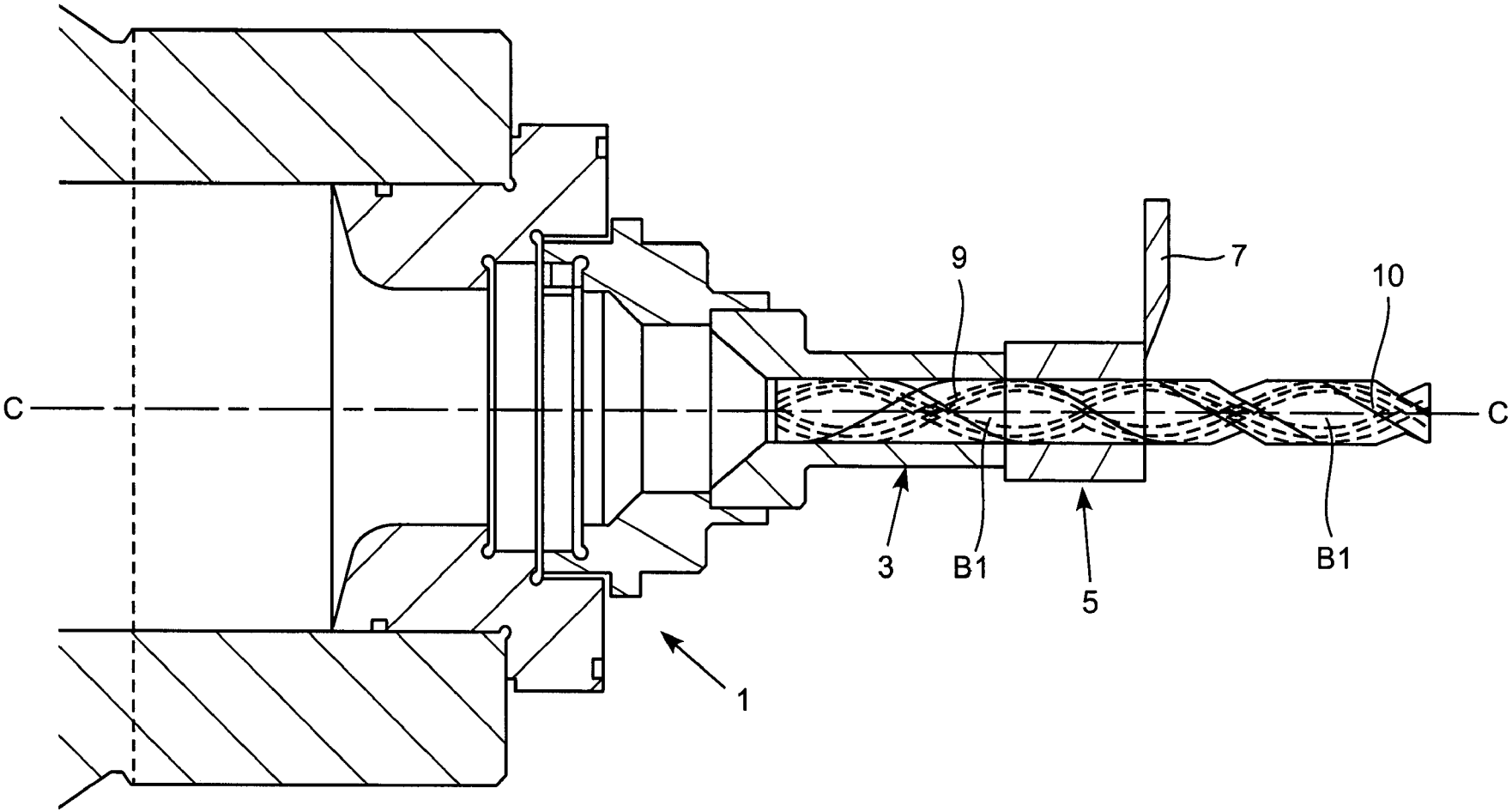
FIG. 2 shows a schematic side view of the device according to FIG. 1, where a first step of the method according to the present invention is illustrated.

In FIG. 1, the design of a device according to the present invention is schematically disclosed, said device being used to carry out certain steps of the method according to the present invention, i.e., to produce blanks/green bodies for helical drills or milling bodies. The method according to the present invention comprises the first preparation of a mixture of cemented carbide, cermet or ceramic powder and a carrier feeding the mixture (not shown) to the device according to FIG. 1 to produce a drill blank/green body which subsequently is sintered and machined. In this application, said mixture is called extruding mass. The device according to the present invention is in the shape of an extruding machine or extruder.

The extruder according to FIG. 1 comprises a housing 1 and a nozzle 3 that is attached to the housing 1. A sleeve 5 is connected to the free end of the nozzle 3, said sleeve 5 defining a cavity 6 that preferably has a cylindrical cross-sectional shape. In the area of the free end of the sleeve 5, a lid 7 is provided, said lid 7 being displaceable in a direction perpendicular to the axial direction C-C of the sleeve 5, said axial direction C-C being the axial direction also of the nozzle 3 and the housing 1. The displacement of the lid 7 closes (either completely or essentially completely) the free end of the sleeve 5.

The suitable length of the sleeve 5 depends on various parameters, such as the consistency of the extruding mass and the internal surface friction. Generally, the length of the sleeve 5 is preferably shorter than the length of the shaft portion of the produced blank.

The extruder according to the present invention also comprises means (not shown) for transferring the extruding mass from the housing 1 and through the nozzle 3 and the sleeve 5.

The interior of the nozzle 3 has the cross-section of a drill with external flutes and the interior of the nozzle 3 is twisted in the longitudinal direction of the nozzle 3. Thus, the interior of the nozzle 3 has the geometry of a helical drill. This is indicated in FIG. 1. For clarity, this helical drill geometry is not indicated in the nozzle 3 in FIGS. 2-8.

The nozzle 3 is also equipped with flexible filaments, said filaments being indicated in FIGS. 2-8 by dotted lines 9. The filaments 9 are anchored upstream of the nozzle 3 by known technique. The filaments 9 have a longitudinal extension all the way up to the free end of the sleeve 5 where the ends of the filaments 9 are loose. The object of the filaments 9 is to produce internal cooling channels 10 in the blank.

When producing a green body/blank of the mixture fed from the housing 1 to the nozzle 3 the following steps are fulfilled. At the start of the extrusion, a helical first blank portion B1 is formed in the nozzle 3, the twisted shape being achieved due to the helical shape of the interior of the nozzle 3, i.e., the mixture that is fed from the housing 1 into the nozzle 3 will be rotated and assumes the shape of a drill body having external helical chip flutes. Simultaneously the filaments 9 are given a twisted configuration inside the blank that fills the nozzle 3.

As the extrusion continues, the helical blank B1 will leave the nozzle 3 and continue into the cavity 6. As is evident from FIG. 2, the first blank portion B1 will have a helical configuration also in the cavity 5 and consequently the filaments 9 will have a twisted configuration in the cavity 6. A further continuation of the extrusion results in the helical blank projecting from the free end of the sleeve 5, see FIG. 2.

Figure 3:
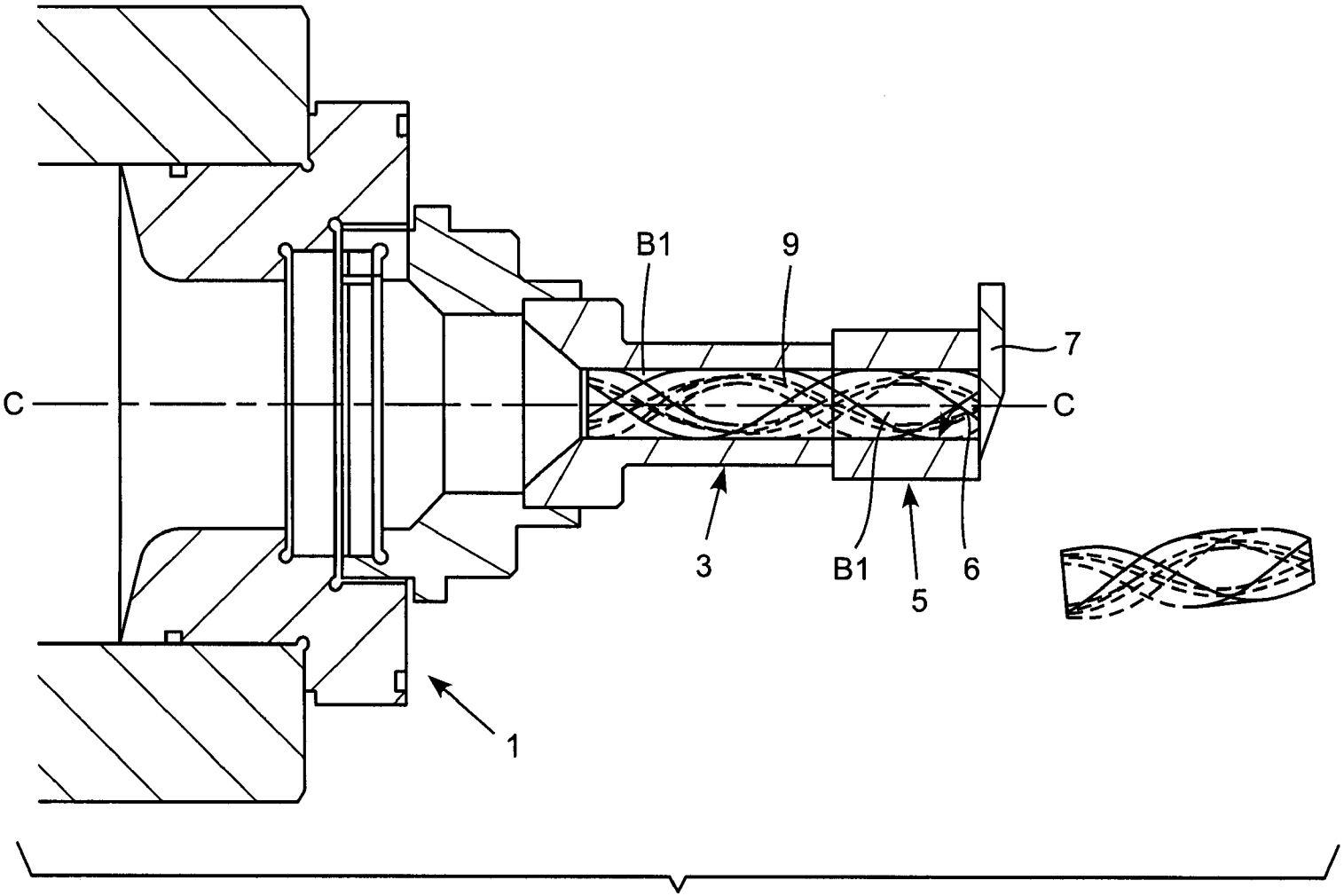
FIG. 3 shows a schematic side view of the device according to FIG. 1, where a second step of the method according to the present invention is illustrated.
Figure 4:
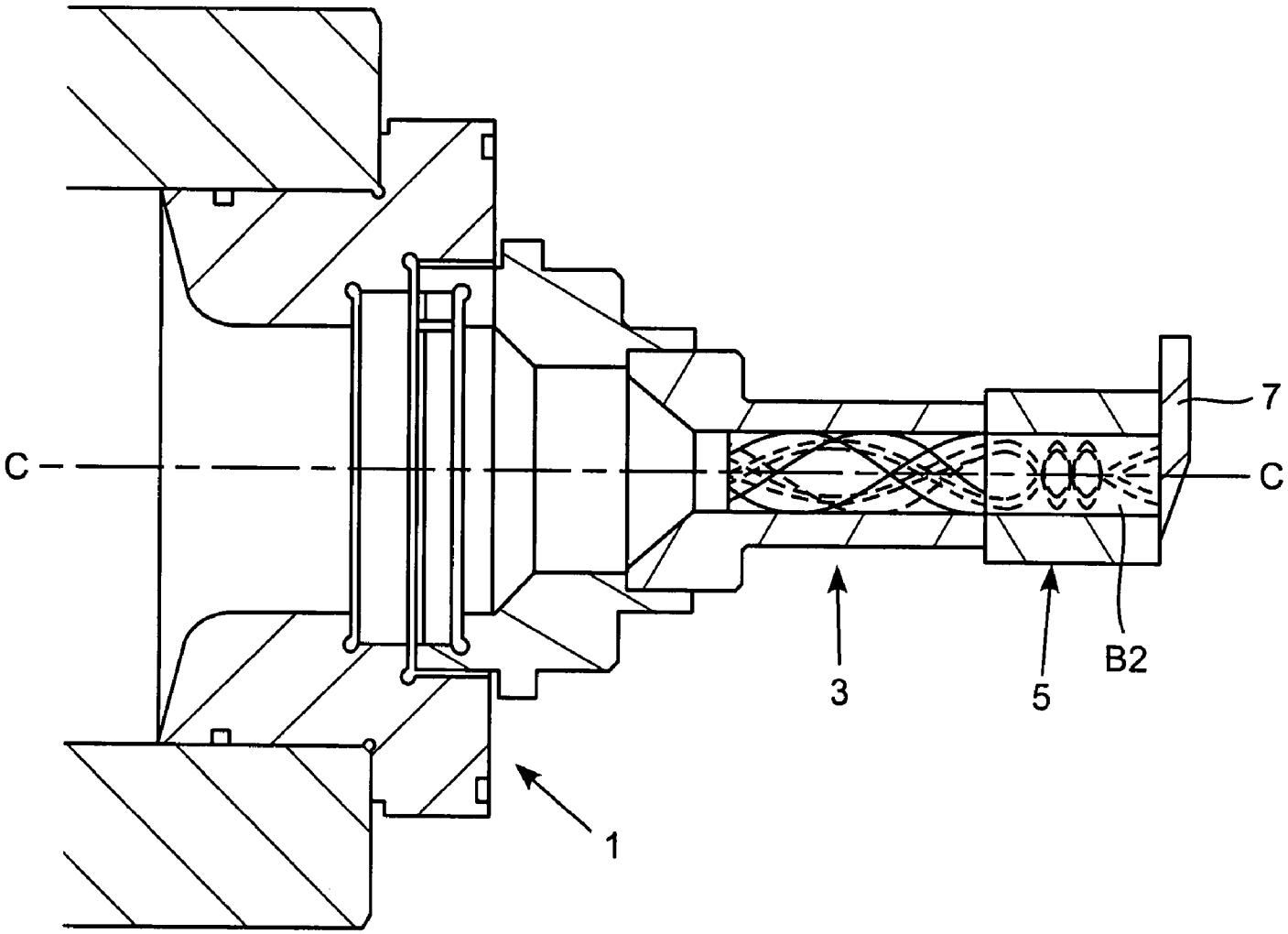
FIG. 4 shows a schematic side view of the device according to FIG. 1, where a third step of the method according to the present invention is illustrated.

In a further step of the method according to the present invention, the lid 7 is displaced to a position, see FIG. 3, where the lid 7 seals the free end of the sleeve 5. The lid 7 is in the shape of a shearing means that cuts off the projecting part of the helical blank, see FIG. 3. Now, the free end of the blank abuts the lid 7. As the extrusion proceeds the external, preformed chip flutes of the blank are filled up inside the cavity 6. When the flutes are filled the pressure in the cavity 6 will increase and the helical filament structure could be disturbed, this being schematically illustrated in FIG. 4. The second portion of the blank having a disturbed filament structure is denominated B2. In this connection, it should be mentioned that it might be favorable that the lid 7 seals the free end of the sleeve 5 only partially, i.e., a certain amount of extruding mass is allowed to bypass the lid 7.

Figure 5:
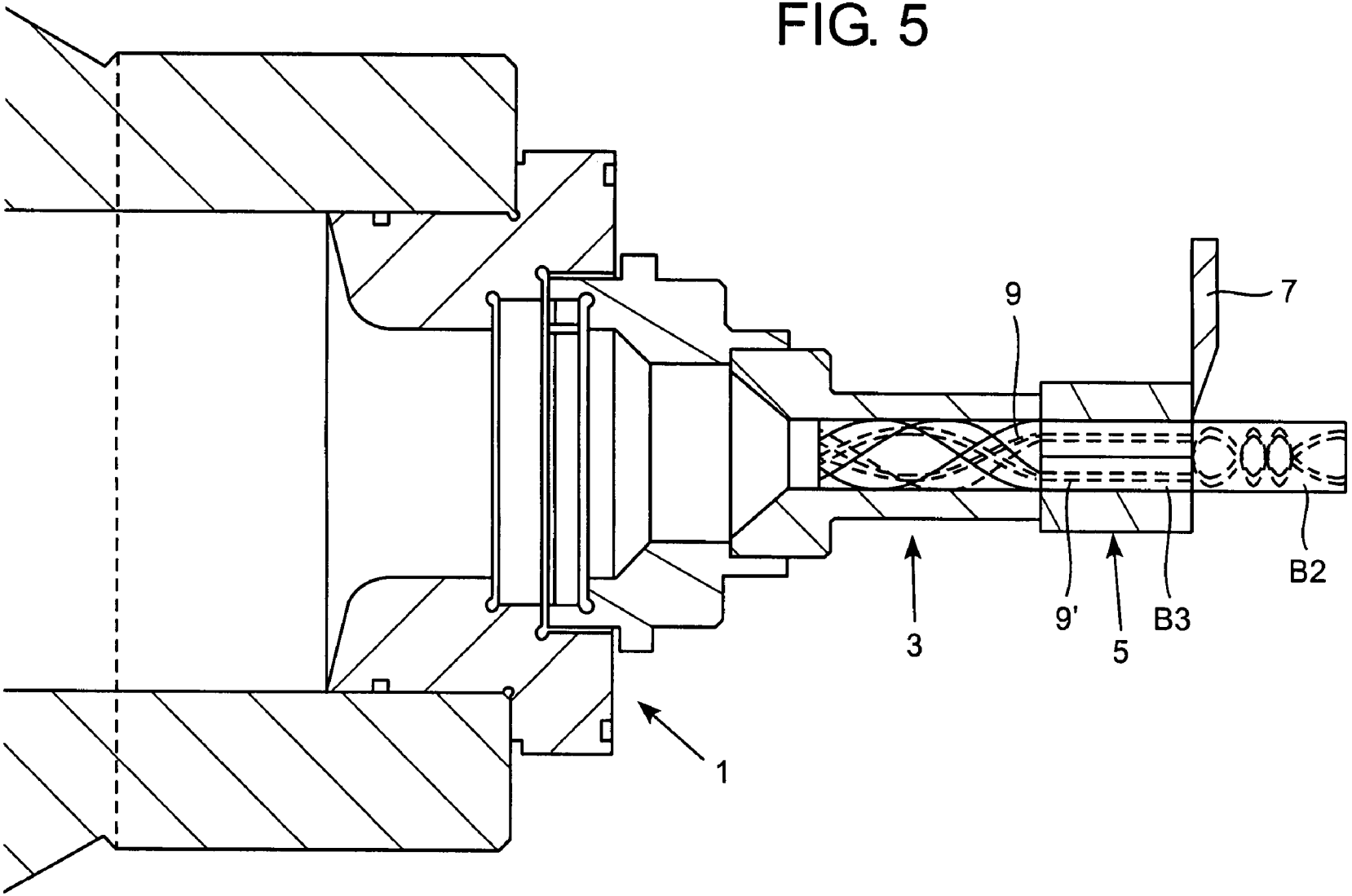
FIG. 5 shows a schematic side view of the device according to FIG. 1, where a fourth step of the method according to the present invention is illustrated.

When the pressure has reached a certain level, the lid 7 is again displaced to open the free end of the sleeve 5. This could be made automatically by introducing a pressure gauge (not shown) in the sleeve 5 that opens at a certain level of pressure. As is illustrated in FIG. 5, the second portion B2 of the blank having a disturbed filament structure is pushed out of the sleeve 5. Due to the friction between the extruding mass and the walls of the cavity 6, the mixture that fills up the cavity 6 will not be in the shape of a helical drill blank portion. Instead, a cylindrical shaft portion will continue to be formed by a substantially non-rotational extrusion in the cavity 6, this third portion of the blank being denominated B3. In this connection it should be pointed out that there is not an abrupt cessation of the rotation of the extruding mass when entering the sleeve 5. In fact, there is a progressive cessation of the rotation of the extruding mass.

If the friction between the interior of the cavity 6 and the extruding mass is low, it may be necessary to close the lid 7 to a certain extent when the second portion B2 of the blank is pushed out of the cavity 6. By such an arrangement, the creation of a cylindrical shaft portion B3 will be facilitated.

Due to the non-rotational performance of the extruding mass in the cavity 6, the filaments 9' have a substantially rectilinear extension inside the cavity 6. When the entire portion B2 is pushed out of the sleeve 5 the lid 7 is activated to perform its shearing function, i.e., the portion B2 is separated from the extrusion string, see FIG. 6. When the second blank portion B2 is separated from the extrusion string, the third blank portion B3 has a length corresponding to the length of the sleeve 5, see FIG. 6. However, by continuing the extrusion process the length of the third blank portion B3 may exceed the length of the sleeve 5, see FIG. 7. In order to continue the extrusion process, the lid 7 must be displaced from its position according to FIG. 6 to its position according to FIG. 7. During the continued extrusion process the length of the cylindrical third blank portion B3 is increased up to a desired value.

Figure 8:
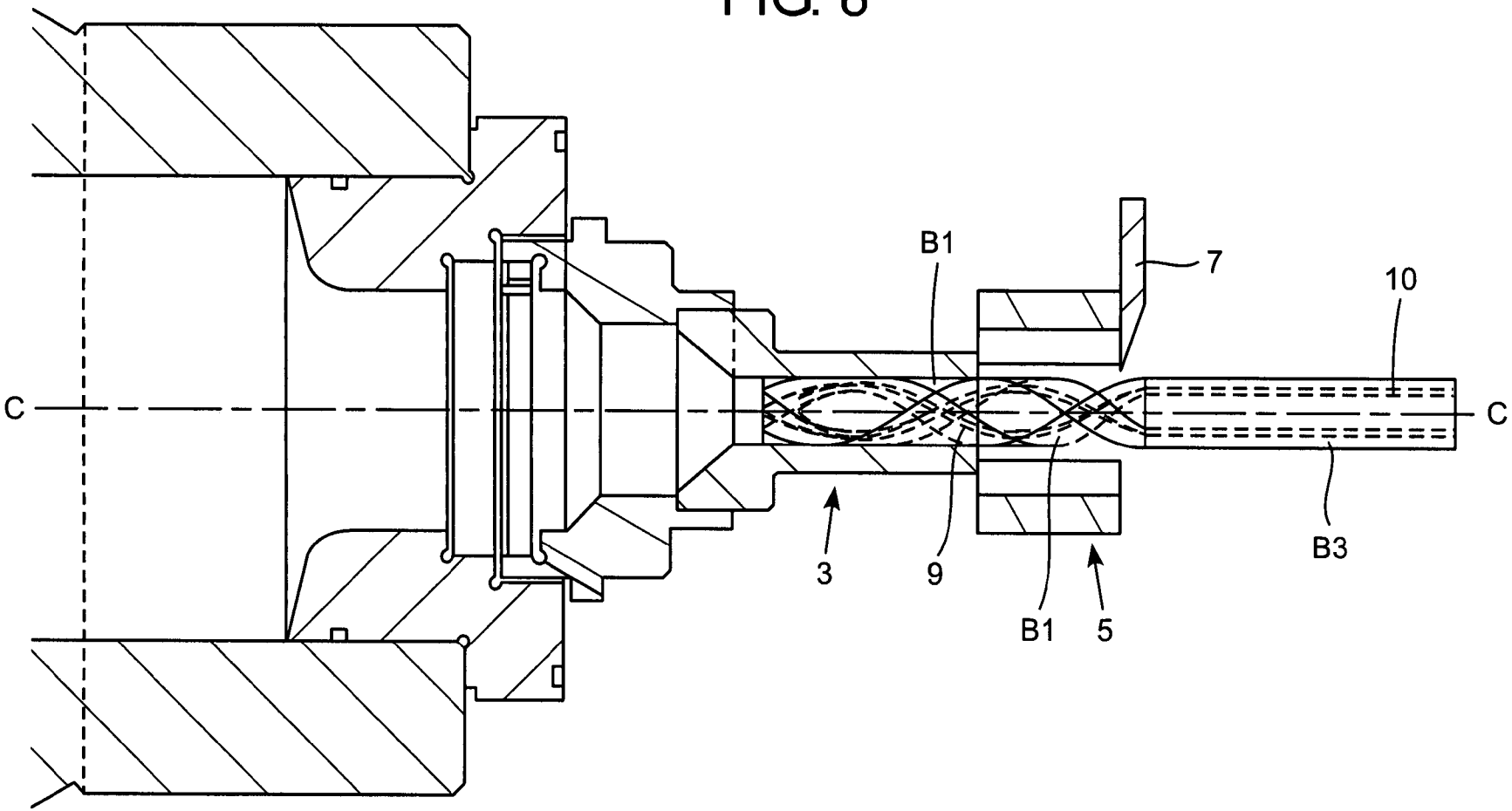
FIG. 8 shows a schematic side view of the device according to FIG. 1, where a seventh step of the method according to the present invention is illustrated.

In order to continue the manufacturing of the first, helical blank portion B1, the friction between the cavity 6 and the extruding mass needs to be decreased. A preferred way to effect this is indicated in FIG. 8, i.e., the sleeve 5 is divided into two or more parts, where said parts may be distanced from each other in the radial direction relative to the longitudinal direction C-C of the blank and the device according to the present invention. Thereby, the friction is reduced and the recreation of the first, helical blank portion B1 is effected when the extrusion process continues. When a desired length of the first blank portion B1 has been achieved, said portion B1 is cut off in a suitable way. The extrusion process then produces a new first blank portion B1. As regards the cutting off of the first portion B1 to create a drill blank and the continuation of the extrusion process, reference is made to FIG. 3.

Figure 9:
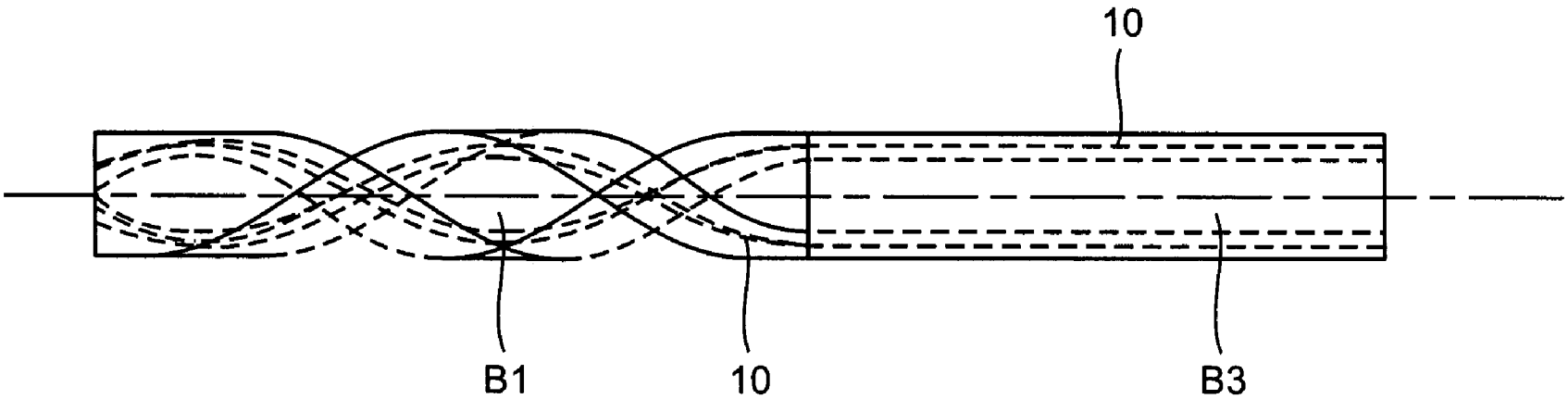
FIG. 9 shows a side view of a drill blank manufactured by the method and the device according to the present invention.

In FIG. 9, the drill blank achieved by the extrusion process described above is shown. The drill blank comprises a portion B1 having helical chip flutes and a shaft portion B3, preferably of cylindrical shape. Internal cooling channels 10 extend along the entire length of the drill blank, said internal cooling channels 10 being essentially rectilinear in the shaft portion B3.

The next step in the manufacturing process for the drill is to sinter the drill blank. Then the tip of the drill is machined to desired shape and dimension.

In the embodiment described above, the drill blank is equipped with internal cooling channels. However, within the scope of the present invention it is also possible to manufacture a drill blank being void of internal cooling channels.

Figure 6:
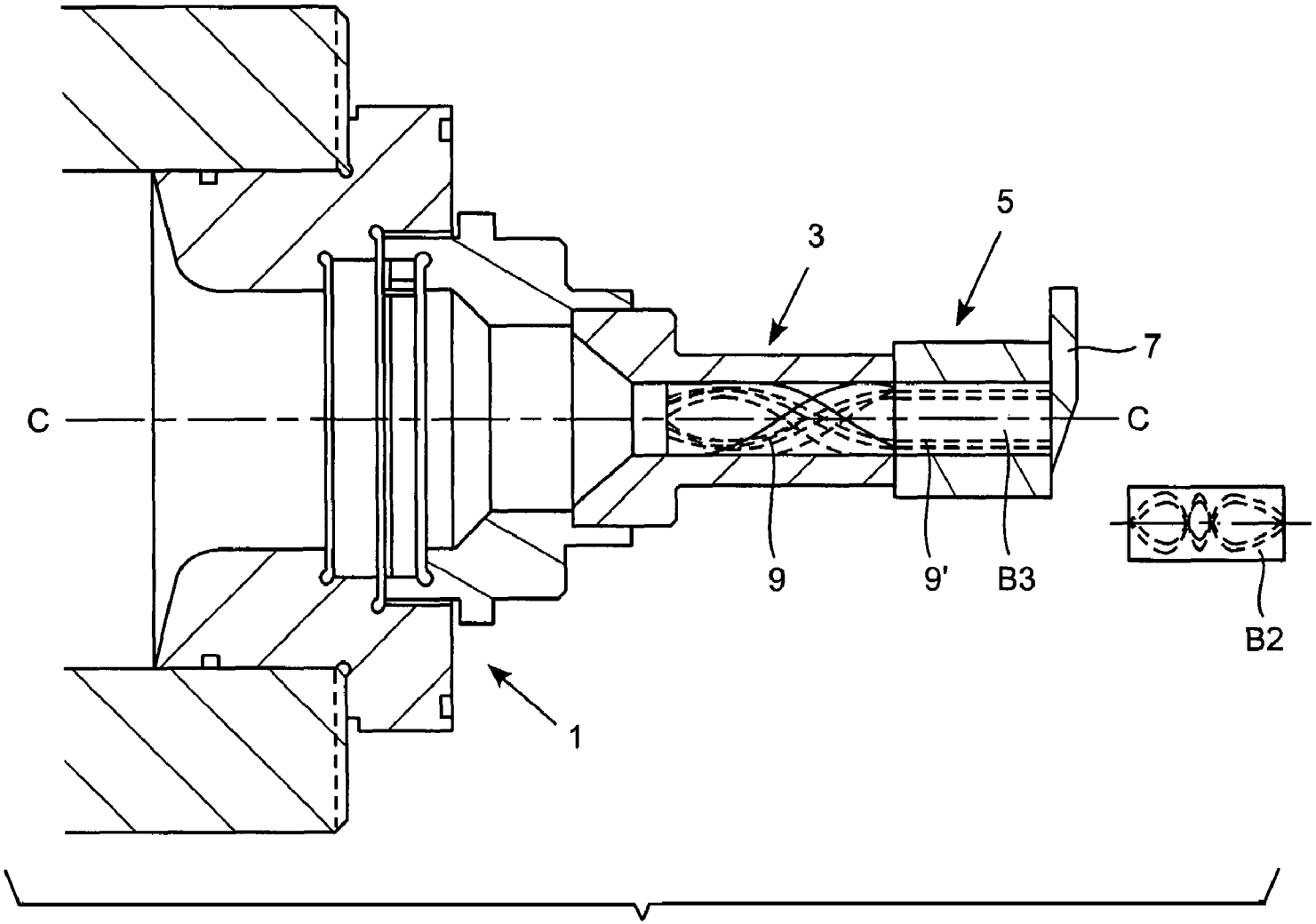
FIG. 6 shows a schematic side view of the device according to FIG. 1, where a fifth step of the method according to the present invention is illustrated.
Figure 7:
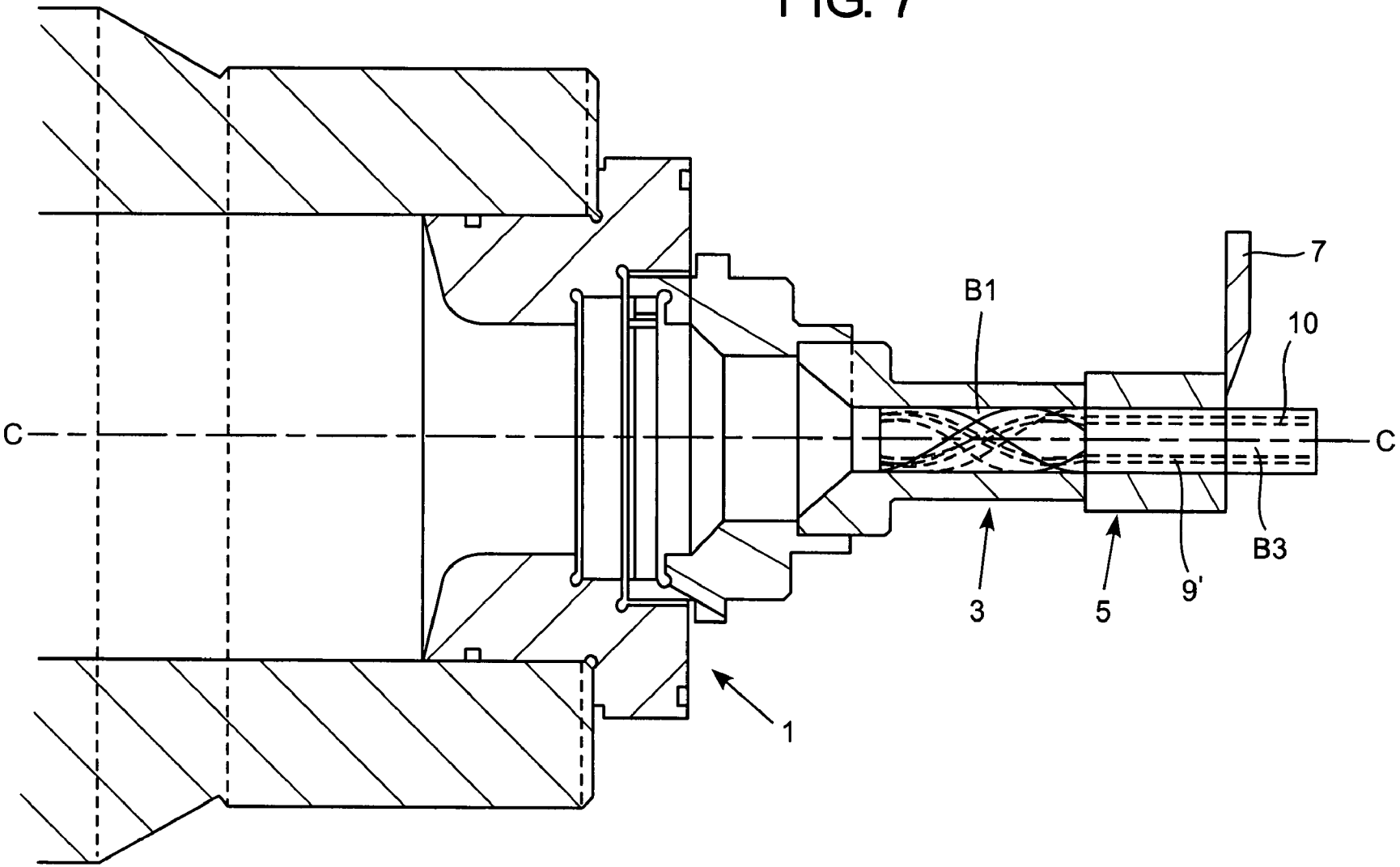
FIG. 7 shows a schematic side view of the device according to FIG. 1, where a sixth step of the method according to the present invention is illustrated.

In the embodiment described above, the second blank portion B2 is cut off from the third blank portion B3, see FIG. 6. This step is carried out under the prerequisite that the second blank portion B2 holds a disturbed filament structure. However, if no internal cooling channels are to be produced in the blank, then there is no need to cut off the second blank portion B2. In this connection it should also be mentioned that during certain advantageous conditions it might be the case that the filaments are not disturbed when the extruding mass fills out the external flutes to produce the blank portion B2. This could be the case if rigid filaments are used for manufacturing of the internal cooling channels. In both these outlined situations the second blank portion B2 will constitute the shaft of the drill that is manufactured in accordance with the present invention.

In the embodiment described above, the internal cooling channels 10 in the shaft portion B3 are essentially rectilinear. However, within the scope of the present invention the internal cooling channels may be somewhat twisted in the shaft portion B3. This may occur if the friction between the inner wall of the sleeve 5 and the extruding mass is relatively low.

In the embodiment described above, the diameter of the blank portion B1 is equal to the diameter of the blank portion B3. However, within the scope of the present invention the sleeve 5 may have a larger diameter than the diameter that is produced by the nozzle 3. It is also possible to manufacture the sleeve in a material that may be widened, e.g., polyurethane. By applying vacuum outside the sleeve 5 the internal diameter of the sleeve 5 may be increased.

In the embodiment described above, the lid 7 performs both a closing function and a cutting function. However, within the scope of the present invention it is feasible that two separate means are provided, one performing closing and the other performing cutting.

In the embodiment described above, a blank for a helical drill is manufactured. However, the present invention may also be used to produce for instance deep hole drills that have rectilinear chip flutes and rectilinear internal cooling channels that both extend in axial direction of the drill. In such a case rigid filaments could be especially suitable.

In the embodiment described above, it is stated that the cavity 6 preferably has a cylindrical cross-sectional shape. It is feasible within the scope of the present invention that the cavity has a non-cylindrical cross-sectional shape. In an exemplifying and non-restricting purpose, a hexagonal cross-sectional shape may be mentioned.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. Method for manufacturing a drill blank or a mill blank by extrusion, said method comprising the forming of a first blank portion having external, axially extending external flutes and the forming of a further blank portion in the shape of a shaft, comprising: extruding a first blank portion having a free end and external flutes such that the free end and an adjacent portion of the first blank portion are extended into a cavity; sealing said cavity in the area of the free end of the first blank portion; further extruding mass to the cavity, said supply of extruding mass completely filling out the external flutes of the first blank portion to produce a second blank portion integral with the first blank portion; terminating said sealing to allow the second blank portion to be pushed out of the cavity; extruding a desired length of the first blank portion; and cutting off the first blank portion at the end facing away from the second blank portion.

2. The method of claim 1, further comprising: producing a third blank portion in the cavity simultaneously as the second blank portion is pushed out of the cavity, said third blank portion being intermediate and integral with the first blank portion and the second blank portion; separating the second blank portion from the third blank portion when the second blank portion is outside the cavity; and extruding a desired length of the third blank portion.

3. The method of claim 1 wherein the sealing of the cavity is only partial.

4. The method of claim 1 wherein internal cooling channels are produced in the drill blank or the mill blank.

5. The method of claim 1 wherein when producing the third blank portion, friction is established between the third blank portion and the cavity.

6. Device for manufacturing a drill blank or a mill blank by extrusion, said device comprising a housing, a nozzle connected to said housing and means to bring an extruding mass in the housing to pass through the nozzle, said nozzle having an internal space that is in the shape of a drill geometry with external, axially extending flutes, a sleeve defining a cavity, said sleeve being attached to the nozzle, and a sealing and shearing means being provided at the end of the sleeve facing away from the nozzle, said sealing and shearing means being able to at least partly seal the end of the sleeve facing away from the nozzle, wherein said sleeve includes a plurality of parts, which translate in a radial direction relative to a longitudinal direction of the drill blank or mill blank.

7. The device of claim 6 wherein the cavity has a cross-section of circular shape.

8. The device of claim 6 wherein filaments are provided inside the nozzle and inside the sleeve, said filaments being anchored upstream of the nozzle.

9. The device of claim 6 wherein the sealing and shearing means are in the shape of a lid that is displaceable transverse to the longitudinal direction of the device, and that the lid is provided with a cutting edge.

10. The device of claim 8 wherein the filaments extend from upstream of the nozzle to the free end of the sleeve.

11. A device for manufacturing a drill blank or a mill blank by extrusion, said device comprising:

a housing;

a nozzle connected to said housing, wherein said nozzle has an internal space that is in the shape of a drill geometry with external, axially extending flutes;

a sleeve defining a cavity, said sleeve being attached to the nozzle; and a translatable sealing and shearing means at the end of the sleeve facing away from the nozzle, wherein said sealing and shearing means in a first position at least partly seals the end of the sleeve facing away from the nozzle, wherein said sleeve includes a plurality of parts, which translate in a radial direction relative to a longitudinal direction of the drill blank or mill blank.

12. The device of claim 11, wherein the cavity has a cross-section of circular shape.

13. The device of claim 11, wherein filaments are provided inside the nozzle and inside the sleeve.

14. The device of claim 13, wherein the filaments extend from upstream of the nozzle to a downstream end of the sleeve.

15. The device of claim 11, wherein the sealing and shearing means are in the shape of a lid that is displaceable transverse to the longitudinal direction of the device, and that the lid is provided with a cutting edge.

16. The device of claim 11, comprising means to bring an extruding mass in the housing to pass through the nozzle.

* * * * *